US007284589B2

(12) United States Patent
Pfeifer et al.

(10) Patent No.: US 7,284,589 B2
(45) Date of Patent: Oct. 23, 2007

(54) REINFORCED CASTING CORES FOR METAL CASTING, MANUFACTURE AND USE

(75) Inventors: Rolf Pfeifer, Boeblingen-Dagersheim (DE); Ralf Lebbing, Ruethen (DE); Jialin Shen, Bernstadt (DE)

(73) Assignee: DaimlerChrysler AG, Stuttgart (DE)

( * ) Notice: Subject to any disclaimer, the term of this patent is extended or adjusted under 35 U.S.C. 154(b) by 94 days.

(21) Appl. No.: 10/895,781

(22) Filed: Jul. 21, 2004

(65) Prior Publication Data

US 2005/0199365 A1 Sep. 15, 2005

(30) Foreign Application Priority Data

Jul. 21, 2003 (DE) ..... 103 32 904

(51) Int. Cl.
*B22C 9/10* (2006.01)
*B22D 29/00* (2006.01)

(52) U.S. Cl. ..... 164/28; 164/132; 164/369; 164/411

(58) Field of Classification Search ..... 164/132, 164/351, 365, 369, 411, 28
See application file for complete search history.

(56) References Cited

FOREIGN PATENT DOCUMENTS

| | | | |
|---|---|---|---|
| DE | 76 30 211 U1 | | 1/1980 |
| DE | 31 44 958 A1 | | 5/1983 |
| DE | 37 39 637 A1 | | 6/1989 |
| JP | 55-97844 | * | 7/1980 |
| JP | 55097844 A | | 7/1980 |
| JP | 60-223640 | * | 11/1985 |

* cited by examiner

*Primary Examiner*—Kuang Y. Lin
(74) *Attorney, Agent, or Firm*—Akerman Senterfitt; Stephan A. Pendorf; Yonghong Chen

(57) ABSTRACT

Sacrificial lost casting cores of green or fired ceramic, which include at least one tension spring as a metallic reinforcing element, wherein at least one end of this reinforcing element lies near one of the surfaces of the casting core or extends therethrough, and wherein the melting point of all metallic reinforcing elements lie above the melting point of the casting metal, as well as processes for production of such casting cores, including the steps of preparing a principal mold, seating therein at least one reinforcing element, filling the principal mold with ceramic slip, drying the slip for formation of a green ceramic and releasing the casting core from the principal mold. The principal mold is preferably lined with a flexible internal mold or liner. The reinforcing element in the form a tension spring can be used following casting for breaking up the ceramic casting core.

19 Claims, 1 Drawing Sheet

REINFORCED CASTING CORES FOR METAL CASTING, MANUFACTURE AND USE

BACKGROUND OF THE INVENTION

1. Field of the Invention

The invention concerns the production of sacrificial casting cores for metal casting, in particular sacrificial casting cores of green or fired ceramic, which include metallic reinforcing elements, and their removal from the metallic castings, as well as principal molds for the production of casting cores.

2. Related Art of the Invention

The manufacture of cast parts with recesses or cutouts places high demands on the manufacturing techniques and the materials for the corresponding casting cores. In the field of metallic casting, due to the high temperatures ceramic molds are employed as a rule.

Slip casting is frequently used in the production of the ceramic casting cores, wherein shaping occurs by pouring liquid slip into a precursor or principal mold. Another frequently seen process is ceramic injection molding, wherein a formable ceramic mass is introduced under pressure into a precursor shape. The slip or ceramic mass is thereupon solidified by drying or, as the case may be, cooling, whereby a green ceramic shape is formed. Particularly in the case of complex shaped casting molds with fine, in part cantilevered or self-supporting structures, there are problems in removal from the mold and problems in the later metallic casting, which are attributable to the insufficient structural stability of the fired and, in particular, the green casting mold.

Already at the time of removal of the green ceramic out of the principal mold the insufficient stability of the material can lead to breakages of the fine structures. The removal of binder from the green ceramic results in general in a substantial mechanical weakening of the casting mold. In this way, in the case of improperly designed structural geometry, defects or breaking of the fine structure or self-supporting mold parts of the casting can occur.

A further source of defects during casting can be traced back essentially to the different densities of the ceramic and the casting metals used, in particular the iron alloys or steels. Since the ceramic in general has a substantially lower specific density than the casting metal, the fine and, in part freely projecting parts of the ceramic casting mold tend to float in the molten metal. This leads to geometric shape defects in certain areas of the cast.

The problem of the insufficient structural stability can in principle be addressed by increasing the sturdiness of the ceramic, for example by ceramic firing (sintering). This however has the serious disadvantage, that the casting mold can only be removed from the cast shape with substantial difficulty following casting. This is the case particularly in the case of casting hollow structures, where the remaining ceramic material is accessible with difficulty.

Further yet, the sintering of the ceramic generally leads to an unacceptable reduction in porosity.

Removal of a crust of remaining ceramic material out of the internal space of the castings is disclosed in JP 55097844 A1. This document discloses among other things polymer bound sand casting molds for casting of metal, reinforced with a spiral or helical shaped metal wire. The start and the end of the metal wire project out of the mold core. After the casting of the metal, the metal wire is pulled out of the casting whereupon the core of casting sand is broken up.

SUMMARY OF THE INVENTION

It is thus the task of the invention to provide geometrically complex casting molds of green or sintered ceramic for metal casting, which exhibit a sufficiently high structural stability to survive the removal from the original mold, as well as to survive metal casting undamaged, and thereupon in simple manner to be released from the casting.

This task is solved by a sacrificial casting core, which includes at least one metallic reinforcing element, which extends primarily along a longitudinal axis of the casting core, a process for producing the casting cores as well as an original mold for making an impression or molding. Preferred embodiments are set forth in the dependent claims.

In accordance with the invention a sacrificial or lost mold is provided for metallic casting, which is mechanically reinforced using at least one metallic reinforcing element. At least one of the metallic reinforcing elements is a tension spring, which is at least in proximity to the surface of the casting core, or in certain cases, near to the core marks. The melting point of the spring or the metallic reinforcing element is preferably at least equal to that of the casting metal.

The term "casting core" is understood herein to refer to a structure contained in a casting mold or a shape which is in greatest part surrounded by flowing casting metal. The casting core can be completely integrated into the casting mold, or only be loosely laid therein. Included in the term "casting core" in the sense in the present invention are those structures which produce a hollow space in the casting body.

In accordance with the invention, one or more metallic reinforcing elements can be contained within the casting core, wherein the casting core itself is comprised of green or fired ceramic. Preferably the casting core essentially contains one metallic reinforcing element, or multiple elements which are connected with each other. The reinforcing effect is, as a rule, higher in the case of green ceramics than in the case of fired ceramics.

With regard to their composition the casting cores can be of the same or of a different material than the rest of the casting mold. Thus, for example, the combination of casting core of green ceramic and a casting mold of fired ceramic or granular molding material (sand) are of particular interest.

The metallic reinforcing element brings about herein, in accordance with the invention, an increase in the structural stability in the fine or mechanically highly stressed areas of the casting mold, as well as in the extended self-supporting areas.

The reinforcing effect is substantial in particular in the case of the green ceramic. However, the sturdiness of the metallic reinforcing element is overall generally above that of the ceramic material also in the case of sintered ceramic, since the casting mold is not fired to a solid and tight ceramic. The increase of the sturdiness imparted by the metallic reinforcing element corresponds herein at least to that amount necessary for undamaged removal of the green ceramic casting core out of the original mold or for undamaged metal casting. Since the metallic reinforcing element remains in the casting core also during the metal casting process, it is advantageous to select the melting temperature of the metallic reinforcing element such that it is above the casting temperature. At least the melting temperature of the reinforcing element should lie above the melting temperature of the casting metal.

For this reason the preferred materials of the metallic reinforcing element include Fe- or Ni-alloys and steels. Further suitable metals are Ti-, W-, Nb- or Ta-alloys.

At least one reinforcing element is preferably oriented along one of the longitudinal axis of the casting mold, particularly in the area of the fine and in part self-supporting structures.

At least one reinforcing element is, in accordance with the invention, a tension spring. In the sense of the invention a tension spring is understood to be a mechanical element with the characteristics of elastically deforming in response to external forces and which, upon release of external forces, returns to the original shape by springing back. This effect can be imparted in the case of springs in this field by the selection of high elastic materials and by suitable design. The most common material for this type of spring is steel.

The inventive reinforcing elements in the form of a tension spring include spiral springs as well as plate springs, a wedge-shaped ring disk tensioned in the axial direction, which can be combined with additional plate-springs into spring packets (in the case of like-oriented stratification) or spring columns (in the case of alternating arrangement).

One preferred embodiment of the tension spring is a screw thread shaped spring, for example produced from round wire in the form of a draw spring or pressure spring, which has a circular diameter. In a first embodiment of the invention the casting core is comprised of a green ceramic which surrounds the metallic reinforcing element. The green ceramic is essentially comprised of ceramic material and organic binder in an amount of 0.1 to 8 wt. %.

The preferred ceramic materials include refractory oxides, in particular the oxides and/or mixed oxides of the elements Al, Zr, Si, Mg, Ca or Ti, or refractory carbides or nitrides of the elements Si and/or Ti. Particularly preferred are $ZrSiO_4$, $Al_2O_3$, SiC and/or $ZrO_2$.

Among the ceramic binders, preferred are those suitable for freeze-drying processes. These include in particular gelatins, agaragar or agarose and glycerin.

It has surprisingly been found that the inventive reinforced casting cores of green ceramic can also be employed in casting molds for metal casting without ceramic firing. By this procedure the process step of ceramic firing can be omitted. It is however of particular advantage that the shrinkage (sinter shrinkage) brought about by ceramic firing is substantially reduced. Here only the thermal decomposition of the organic binders and the shrinkage of the casting core caused by the short exposure to the casting temperature occur. The low stability of the ceramic materials produced hereby are increased by the inventive metallic reinforcing element. The small shrinkage of the casting core has a very positive effect on the dimensional stability of the casting. The green casting cores can thus be components of a casting mold of fired ceramic as well as of green ceramic.

In a further embodiment of the invention the casting core which surrounds the metallic reinforcing element is fired ceramic. The preferred ceramic materials are the same as discussed above for the green core. The fired ceramic therein typically exhibits a porosity of greater than about 5%.

The preferred tension springs include the springs made of round wire wound into spiral or helical shapes and tension springs with high spring constants and those of steels.

A particular advantage of the inventive metallic reinforcing elements is based on their design as tension springs. Following casting, the tension spring can be pulled out of the cast part or casting, whereby the casting core is mechanically stressed internally. As a rule the ceramic material under this mechanical stress suffers brittle fractures and breaks into small pieces. These small pieces fall out of the casting in part as loose pieces, or can be removed in simple manner by particle blasting techniques such as sand blasting or water impacting techniques.

In a further inventive embodiment of the invention at least one of the metallic reinforcing elements is partially or entirely separated from the surrounding casting core. In the case of the ceramic casting core the separation is a gap or cleft.

In the case that the casting core of grain ceramic the partial or full separation inventively occurs using pyrolyzable organic material. Therein it is to be noted that the organic material decomposes at least in part upon ceramic firing or at least upon the preheating to the casting temperature, and thereby produces essentially the same situation as in the case of ceramic casting cores which exhibit a gap. Among pyrolyzable organic materials, waxes or thermal plastics are, for example, well suited.

In a further inventive variation, this separation is caused by a flexible and compressible hose, which is comprised at least in part of a pyrolyzable material. Examples therefore are silicon hoses, as well as polymer or wax impregnated fiberglass or carbon fiber webbed hoses.

The gap can preferably function as a ventilation or evacuation channel or a riser. The ventilation channel therein brings about an improved decomposition and degassing of the organic binders of the green ceramic during firing. The gap breadth is typically less than 2 cm and preferably in the range of 0.02 to 2 mm.

The gaps formed around the tension spring or as the case may be the reinforcing element can therein further improve the mechanical disruption of the ceramic during pulling out, in that they afford some play or a gap for the back and forth movement of the reinforcing element.

The inventive sacrificial or destructible casting core is suitable in particular for production of casting parts with hollow spaces, recesses or cavities. Preferred areas of use are components for internal combustion engines or steels or like metals, in particular engine blocks. Particularly preferred are ceramic casting molds with casting cores of green ceramic.

A further aspect of the invention concerns a process for production of reinforced sacrificial casting cores for metal casting.

BRIEF DESCRIPTION OF THE DRAWINGS

In the following the invention will be described in greater detail on the basis of schematic illustrations. The illustrations are to be understood as merely being examples and are not to be construed as limiting the scope of the invention.

Therein there is shown.

DETAILED DESCRIPTION OF THE INVENTION

Figure 1:
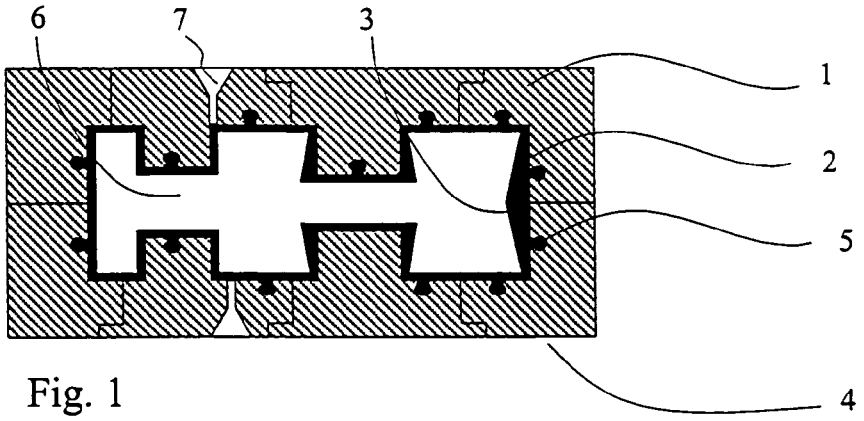
FIG. 1 a principal or original mold (4) of multiple segments (1), a flexible internal mold (2), which includes cutbacks (3), anchoring nubs (5), a mold cavity (6) and filler necks (7)
Figure 2:
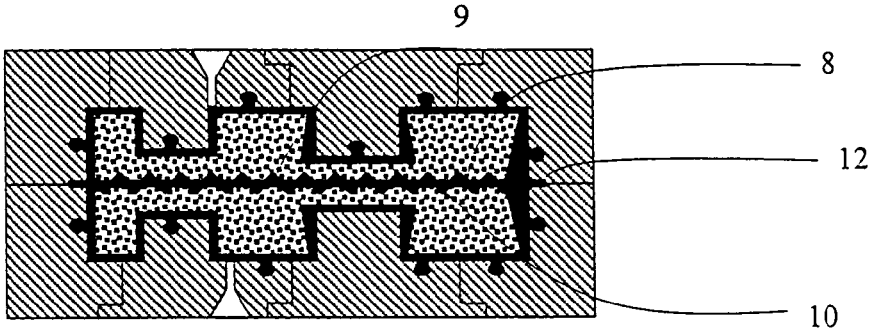
FIG. 2 a principal mold (4) filled with ceramic slip (9), with metallic reinforcing elements (8), namely tension spring (10) and metal wire (12)
Figure 3:
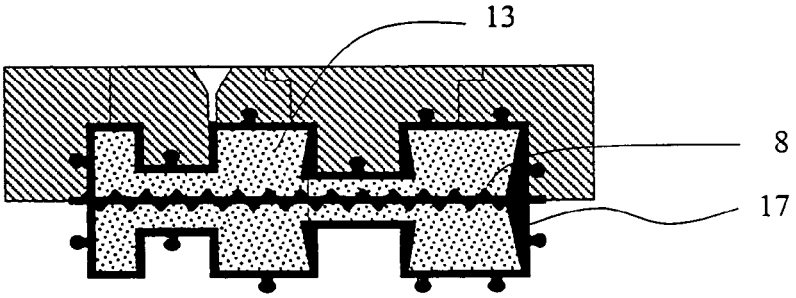
FIG. 3 a partially opened principal mold with a casting core (17) of frozen ceramic slip (13) and embedded metallic reinforcing elements (8)

In accordance with the invention, the process includes the following steps

- preparing an original mold (4), wherein the original mold can include multiple segments (1) as well flexible internal molds (2)
- fitting at least one elastically deformable metallic reinforcing element (8), including at least one tension spring (10), into the original mold (4)
- filling the original mold (4) with ceramic slip (9)
- drying and thereby forming a dried ceramic slip (13) or, as the case may be, green ceramic in the form of a casting core (17)
- removal of the casting core (17) out of the original mold.

The principal mold can be made of almost any hard material, for example plastic, ceramic or metal. The principal mold is preferably made of metal.

Preferably the principal mold is made of multiple separable segments (1).

In a preferred embodiment of the principal mold, one or more flexible internal molds or liner (2) are contained therein. These internal molds are for example made of rubber or silicon. Particularly preferred is to have the internal molds connected with the principal mold via connecting techniques for example via nubs for fixation (fixing nubs (5)). The inner molds of flexible material typically exhibit cutbacks (3) and/or complex geometries. The principle mold or form, which can be comprised of multiple parts, corresponds to the general shape of the principal model, essentially without cutbacks and complex geometries. For filling the principal mold, filler necks (7) can be provided. After freezing of the slip the flexible internal mold or liner can be pulled from the frozen ceramic part in order to allow for drying of the component in a freeze-dryer.

At least one reinforcing element (8) is seated in the principal mold, wherein at least one of these is a tension spring (10). One or more reinforcing elements can therein also be built up of multiple individual elements. For example, the reinforcing element can be a metal wire (12) and a tension spring (10) associated therewith. Further embodiments of the reinforcing element include for example corrugated sheets, spiral or helical wires or plate springs.

Preferably at least one of the metallic reinforcing elements is oriented along the longitudinal axis of the casting core.

Preferably at least one of the metallic reinforcing elements is so fitted or seated, that at least one of its ends lies near to the surface of the casting core or projects out therefrom. This one end of the metallic reinforcing element is therein at least so close to the surface that following the casting process it is easily accessible and allows itself, upon application of external force, to stretch and be pulled out of the casting core.

In a further embodiment of the invention at least one of the reinforcing elements is coated with pyrolyzable material or is surrounded by a hose, in particular a ventilation (off gassing) hose. Therein the hose is likewise at least pyrolyzable in part. The term pyrolysis is herein understood to be the partial or complete thermal decomposition of the material. The coating or the (off gassing) hose can act as a buffer during the drying of the slip, as well as during sintering of the green ceramic, for the shrinkage processes which occur, since the corresponding material of the coating or hose is relatively soft. In particular the direct shrinkage and contact-rubbing of the green or sintered ceramic on the metallic reinforcing element is prevented.

The coating or the off gassing hose provides a further advantage for the removal of the reinforcing element from out of the cast shape following casting. Since the coating or the off gassing hose decomposes at least in part pyrolytically prior to or at the casting temperature, a gap is formed during casting, which can act as an off-gassing channel. The gap beyond this facilitates the removal of the reinforcing element and the breaking up of the ceramic casting core. The coating can be made for example of waxes or thermal plastics.

A further embodiment of the invention includes hollow metallic reinforcing elements, for example pipes or hollow helices or spirals. The hollow spaces exhibit a similar effect to that of the gaps between reinforcing element and casting core material.

Following the seating of the metallic reinforcing element and the, in some cases, further metallic elements, the filling of the principal mold with ceramic slip occurs. The slip in general comprises powders of refractive oxides or carbides, binders and solvents.

The particularly preferred slips include aqueous slips. The particularly preferred binders include those suitable for freeze-drying processes, for example gelatins, agaragar, glycerin and agarose.

In a subsequent process step the drying or, as the case may be, solidification of the slip and the removal of the solvent occurs.

In accordance with the invention the drying process is so selected that a minimum of shrinkage of the slip occurs during drying.

The particularly preferred processes include freeze-drying. Herein only a minimum of shrinkage results. By the drying of the ceramic slip a green ceramic is formed in the shape of the later casting core.

The casting core is thereupon removed from the principal mold. As a result of the inventive reinforcing elements the casting core possess sufficiently sturdiness, even in the case of complex geometries, high porosity or green ceramic, and even in the case of a low binder content. Even long and thin casting cores can, in accordance with the invention, be removed without problem. As binder, even minimal amounts in the range of a few percent can be sufficient. Preferred slip compositions have a gelatin content of less than 3 wt. %.

The flexible inner shapes or liners (2) can, in certain, cases be reused.

For the production of cast parts the casting core is used as a complete casting mold or as a part of a casting mold. Therein the casting core can be used in the green form or in the sintered form.

Figure 4:
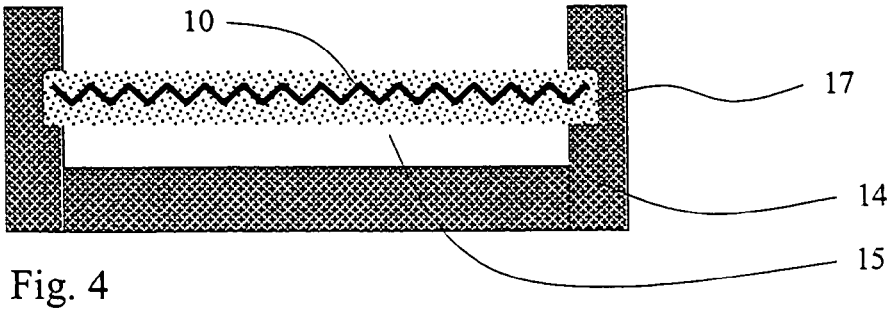
FIG. 4 an assembled casting mold (14) with a metal reinforced frozen casting core (13), with a tension spring (10) and a casting cavity (15).

A preferred embodiment of the invention envisions the assembly of multipart cast molds such as shown for example in FIG. 4. Therein the casting core (17), as well as the casting mold (14) can be of green ceramic or a sintered ceramic. If green and sintered ceramics are to be employed simultaneously, then the casting mold (14) is preferably of sintered material and the casting core of green material. The casting mold (14) can therein be provided with reinforcing elements in the same or similar manner as the inventive casting core.

With regard to the ceramic casting core, these are sacrificial or lost cores which, following the casting of the metal, are destroyed by the pulling out of at least one of the metallic reinforcing elements.

The ceramic broken up thereby can be removed from the cast shape with comparably little effort. In particular, particle blasting or water blasting can be employed in order to remove the broken pieces and residue of ceramic out of the cast shape.

The inventive reinforcing elements have the advantage that they can be used for large surface area breaking up of the reinforced casting core, and therewith substantially simplify the removal of the cast part from the mold.

EXAMPLE

First a prototype of the casting core was produced of plastic. This occurred by a generative rapid prototyping process. Thereupon a principal mold generally defining the geometry of the prototype model was formed of multiple segments (1) of polyurethane. The intermediate spaces between the prototype model and the principle mold were cast-in with a thin liquid silicon mass which, following hardening, formed a flexible internal mold or liner (2) with cutbacks (3).

Into this principle mold a metal wire surrounded by a tension spring was seated. Tension spring and metal wire were comprised of spring steel.

The mold was preheated and the hot slip was cast into the mold without pressure.

This slip was produced in the following manner:

At 60° C. a concentrated solution having 25 wt. % gelatin was produced in order to be mixed in a later process at a temperature of approximately 50° C. with the ceramic suspension.

For production of the ceramic suspension, $ZrO_2$, $ZrSiO_4$ and $SiO_2$-powder were mixed and dispersed in water for 1 hour at average rotational speed in a plastic grinding container using $Al_2O_3$ grinding balls in a planetary grinding mill. Thereupon the gelatin solution was added and mixed for an additional 30 minutes.

The slip produced in this manner had a gelatin content of 3.7 wt. % and a solids content of 60 wt. %.

Thereupon the grinding balls were removed and the slip was cooled to a temperature of approximately 40-45° and cast into the principle mold with flexible inner shapes. Thereupon the gelatin was slowly cooled to below the gelation temperature (approximately 35° C.) and the entire mold was frozen in a cooler to −30° C. Thereupon the principle mold was removed or, as the case may be, the flexible inner liner was released. For handling purposes, the frozen slip was maintained at a temperature below approximately −10° C. An intermediate storage of the casting core at approximately −2° C. was possible without occurrence of damage.

The casting core of frozen slip was thereupon freeze-dried at a temperature of approximately −30° C. and a pressure in the vicinity of 1-100 Pa. The freeze-dried component was thereupon subjected to a further drying at 60° C. in a drying cabinet.

The green casting core was introduced into a ceramic casting mold and used for casting of molten steel. The principle design of the casting core corresponded to that of FIG. 4.

Following casting, the ceramic casting core was removed and the tension spring of the casting core, which was virtually completely surrounded by casting metal, was exposed at two opposite ends. By pulling of the ends of the tension spring the casting core was broken up into small and loose broken pieces and could be completely removed by a water jet.

The invention claimed is:

1. A sacrificial lost casting core for metallic casting, including at least one metallic reinforcing element in the form of a tension spring, wherein at least one end of this reinforcing element lies at least near one of the surfaces of the casting core or extends therethrough, wherein the melting point of all metallic reinforcing elements is at least equal to that of the casting metal, wherein the at least one metallic reinforcing element is partially or completely separated from the surrounding casting core by a gap or by a pyrolyzable organic material coated on the at least one metallic reinforcing element.

2. The sacrificial casting core according to claim 1, wherein the at least one metallic reinforcing element is in the form of a spiral spring, helical spring, plate spring or steel spring with close-fitting wires, or a hollow spring, for taking tension upon pulling in one of the longitudinal axis of the casting core.

3. The sacrificial casting core according to claim 1, wherein the at least one metallic reinforcing element is oriented along the longitudinal axis of the casting core.

4. The sacrificial casting core according to claim 1, wherein the casting core is comprised of porous fired ceramic, or of green ceramic including ceramic material and organic binders in an amount of 0.5 to 8 wt. %.

5. The sacrificial casting core according to claim 4, wherein the organic binder contains as main components gelatin, agaragar, glycerin or agarose.

6. The sacrificial casting core according to claim 1 wherein the gap or the pyrolyzable organic material extends to one of the surfaces of to casting core.

7. The sacrificial casting core according to claim 1 wherein the pyrolyzable organic material is wax or thermoplastic.

8. A method for casting components for internal combustion engines of steel or light metal using a sacrificial lost casting care according to claim 1, the method comprising:

preparing a principal mold, seating at least one elastically deformable metallic reinforcing element in the principal mold, wherein the reinforcing element is coated with a pyrolysable material or is surrounded by a hose, filling the principal mold with ceramic slip by casting or dipping, forming of the casting core by drying of the slip to form a green ceramic, releasing the casting core from the principal mold, introducing the casting core into a casting mold, and casting the components for internal combustion engines of steel or light metal in the casting mold.

9. The method as in claim 8, wherein the ceramic casting cores are comprised of an assembly of multiple parts.

10. A process for producing a reinforced sacrificial casting core according to claim 1, which includes the following steps:

preparing a principal mold, searing at least one elastically deformable metallic reinforcing element in the principal mold, filling the principal mold with ceramic slip to form the casting core, releasing the casting core from the principal mold, the filling of the principal mold with ceramic slip occurs by casting or dipping, the shaping or forming of the casting core occurs by drying of the slip with formation of a green ceramic the reinforcing element is coated with a pyrolysable material or is surrounded by a hose.

11. The process according to claim 10, wherein the drying of the slip occurs by freeze-drying.

12. The process according to claim 10, wherein at least one metallic reinforcing element is so seated or introduced, that at least one end lies near or at the surface of the casting core or extends out therefrom.

13. The process according to claim 10, wherein at least one reinforcing element is so seated, that it is oriented along one of the longitudinal axis of the casting core.

14. The process according to claim 10, wherein the at least one metallic reinforcing element is a tension spring.

15. The process according to claim 10, wherein the at least one metallic reinforcing element is at least partially surrounded by plastic or wax.

16. The process according to claim 10, wherein the casting core is fired at a temperature below the melting temperature of the metallic reinforcing element.

17. The process according to claim 10, wherein the principal mold (4) is comprised of a liquid-tight assembly of multiple individual segments (1), and is lined with a flexible inner mold or liner (2) of elastomer, rubber or silicon rubber.

18. The process according to claim 10, wherein the inner mold or liner (2) is connected with the principal mold (4) via connecting elements.

19. The process according to claim 18, wherein the connecting elements are attachment nubs (5).

* * * * *